United States Patent [19]

Collins et al.

[11] Patent Number: 4,597,432

[45] Date of Patent: Jul. 1, 1986

[54] MOLDING DEVICE

[75] Inventors: Richard J. Collins; Frank E. Wagstaff; William G. Wagstaff, all of Spokane, Wash.

[73] Assignee: Wagstaff Engineering, Inc., Spokane, Wash.

[21] Appl. No.: 618,778

[22] Filed: Jun. 11, 1984

Related U.S. Application Data

[63] Continuation of Ser. No. 258,520, Apr. 29, 1981, abandoned.

[51] Int. Cl.[4] ..... B22D 11/124

[52] U.S. Cl. ..... 164/444; 164/348; 164/439; 164/487

[58] Field of Search ..... 164/249, 348, 437, 439, 164/444, 486, 487, 488

[56] References Cited

U.S. PATENT DOCUMENTS 3,780,789 12/1973 Unger ..... 164/486
3,885,617 5/1975 Foye ..... 164/444

OTHER PUBLICATIONS

Attached copy of schematic representation of "Hot Top" and Conventional Pour casting devices, taken from brochure published by Wagstaff Engineering, Inc., Spokane, Washington, entitled *Extrusion Billet Casting.*

Attached copy of Section B–B, Engineering drawing S–1424 dated Jan. 16, 1980, M and T Manufacturing Company, Grand Rapids, Michigan, entitled 36 *Way Hot Top Distribution Pan.*

*Primary Examiner*—Nicholas P. Godici
*Assistant Examiner*—Richard K. Seidel
*Attorney, Agent, or Firm*—Christopher Duffy

[57] ABSTRACT

One or more top-opening mold cavity defining members are supported in the chamber of a coolant box adapted for the flow of liquid coolant therethrough about the members. Each member is supported in a telescoping assembly in which the top opening of the member is co-axial with an opening in the top of the chamber to enable molten metal to be introduced to the cavity of the member through the respective top openings of the chamber and the member. Moreover, each member has a greater outer peripheral diameter transverse the axis than the top opening of the chamber, and is engaged with the top of the chamber about the opening thereof in a first horizontal plane of the box. The member is also engaged with the defining surfaces of the chamber in a second horizontal plane of the box spaced below the aforesaid first horizontal plane of the box by a vertical gap. Should liquid coolant leak into the gap through this second line of engagement, it is discharged from the gap at a level below the first horizontal plane of the box, and to a point outside of the chamber at which the leakage cannot reach the cavity of the member along the first mentioned line of engagement at the top of the chamber. As a result, the top opening of the chamber need only be large enough to enable the metal to be charged through the same, and the number of openings in the top of the chamber can be increased and/or spaced more closely to one another to maximize the number of molding stations in the device.

69 Claims, 5 Drawing Figures

MOLDING DEVICE

This Application is a continuation of Application Ser. No. 258,520, filed Apr. 29, 1981 under the title MOLDING DEVICE AND METHOD OF FORMING THE SAME now abandoned.

THE INVENTION IN GENERAL

This invention relates to a metal molding device, and in particular to a device of this nature wherein one or more top-opening mold cavity defining members are supportable in a coolant box having inside surfaces thereof which define the relatively top, bottom and side walls of an enclosed chamber adapted for the flow of liquid coolant through the box about the members. For each member, the top of the chamber has an opening therein on a vertical axis of the box, and there are means on the bottom of the box whereby the mold cavity defining member is insertable in the chamber on the axis. There are also support means adjacent the bottom of the chamber whereby the member is supportable in the box in a telescoping assembly in which the top opening of the member is co-axial with the top opening of the chamber to enable molten metal to be introduced to the cavity of the member through the respective top openings of the chamber and the member. According to the invention, the mold cavity defining member has a greater outer peripheral diameter transverse the axis than the top opening of the chamber, and there are first means on the mold cavity defining member and the box forming a first line of engagement between the member and the defining surfaces of the chamber in which a top surface of the member about the opening thereof engages the top of the chamber about the opening thereof in a first horizontal plane of the box. There are also second means on the mold cavity defining member and the box forming a second line of engagement between the member and the defining surfaces of the chamber about the aforesaid top surface of the member. The second line of engagement is formed in a second horizontal plane of the box which is spaced below the aforesaid first horizontal plane of the box by a vertical gap, and is adapted to forestall liquid coolant from entering the cavity of the member along the top surface thereof. However, there are means associated with the box for discharging liquid coolant from the chamber, and the coolant discharge means are disposed so that any liquid coolant which leaks into the gap through the second line of engagement is discharged from the gap at a level below the aforesaid first horizontal plane of the box and to a point outside of the chamber at which the leakage cannot reach the cavity of the member along the aforesaid top surface thereof. In this way, because the mold cavity defining member can be installed in the chamber without being bodily inserted as a whole through the top opening thereof, the top opening of the chamber need only be large enough to enable molten metal to be charged through the same into the cavity of the member, and any means in and/or above the opening for this purpose can be left in place when the member is removed from the chamber for any reason. Also, in those cases where the chamber has a plurality of mold cavity defining members installed therein, and a top opening for each, the number of openings can be increased and/or the openings can be spaced more closely to one another in order to maximize the number of molding stations in the device.

There are many features to the invention. For example, in many of the presently preferred embodiments of the invention, the box has a recess in the top thereof which communicates with the vertical gap in the chamber. The gap opens to the outside of the chamber at a level below the aforesaid first horizontal plane of the box, and the leakage discharge means are connected with the gap at the opening thereof to discharge the leakage to a point outside of the chamber. In certain embodiments, the top surface of the mold cavity defining member engages the top of the chamber along a line disposed in the plane of the top opening of the member; and in some embodiments, the top surface of the member also engages the top of the chamber along a line disposed in a plane spaced below the aforementioned plane of the top opening of the member, and the vertical gap between the two lines of engagement opens into a sump disposed peripherally outwardly of the member and opening into the ambient surroundings of the box so that any coolant which rises above the relatively lower plane is discharged from the chamber before the coolant can reach the plane of the opening in the member.

In addition, in many embodiments, the device further comprises hollow post-like means upstanding in the chamber between the top and bottom of the box, and the post-like means open into the ambient surroundings of the box at the bottom thereof and communicate with the gap in the chamber.

The box may have a step in the top surface of the chamber, and the gap in the chamber may communicate with the ambient surroundings of the box at the step. In some embodiments, the member terminates at the inner peripheral edge of the top opening of the chamber and engages the walls of the chamber to prevent coolant from leaking into the cavity of the member through the top opening thereof.

Preferably, the second line of engagement has a greater diameter in the chamber than the top opening thereof.

In one group of embodiments, the upper end surface of the member about the edge of the top opening therein abuts the top of the chamber, and there is a step in the top of the member spaced peripherally outwardly from the top opening thereof, which abuts a mutually opposing step in the top of the chamber, in the aforementioned plane spaced below the plane of the opening in the member. One of the steps opens into a recess in the top of the box, which opens in turn into a drain line that discharges through an outlet in the bottom of the box. The drain line may pass through a portion of the chamber; and in certain embodiments, there is a groove in the top of the box which opens into the step in the top of the chamber, and discharges to the bottom of the box through a hollow post interposed between the top and bottom of the box in the chamber.

In still other embodiments of the invention, the gap has a pressure which is adapted to prevent chamber coolant from leaking into the top opening of the member. For example, in certain embodiments, the gap has a pressure which is adapted so that any coolant that leaks through the second line of engagement is discharged to a point outside of the chamber before the coolant can reach the top opening of the member. In some embodiments, the gap opens into a sump below the top opening of the member and the pressure in the sump is adapted so that the leakage coolant will discharge into it by gravity flow. In certain of these, the sump opens to the ambient surroundings of the box so that the pressure in the gap corresponds thereto. Preferably, the sump is disposed about the periphery of the gap. For example, the sump may open into the ambient surroundings of the box at a point between the gap and the periphery of the box. In certain embodiments, the sump opens into the bottom of the box.

As for the mold cavity defining member itself, it may be annular for through molding purposes, such as billet casting, and in such a case, the chamber may have a bottom opening therein through which the molded work product can emerge from the box at the bottom thereof. In certain embodiments, the chamber has a bottom opening therein on the aforesaid vertical axis of the box through which the mold cavity defining member is insertable in the chamber, and there are means on the member within the diameter of the bottom opening of the chamber through which liquid coolant in the chamber is metered onto the work product emerging from the member at the bottom thereof.

Often, where the mold cavity defining member is annular and the chamber has a bottom opening therein through which the molded work product can emerge from the box at the bottom thereof, there is an aperture about the bottom opening of the member whereby the chamber coolant can discharge onto the emerging work product during the molding operation. For example, in certain embodiments of the invention, the top and bottom openings of the member are coaxial with the top and bottom openings of the chamber, and the discharge aperture is formed between the body of the member and the bottom opening of the chamber. In some embodiments, the member has substantially the same diameter as the bottom opening of the chamber, and there are means in the bottom portion of the member which communicate with the chamber of the box at a point above the bottom opening therein to form the discharge aperture. In certain embodiments, the member has a circumferential groove about the waist portion thereof, and an annular rabbet at the bottom thereof which is interconnected with the groove by a series of apertures through which the chamber coolant can discharge onto the emerging work product from the groove. Preferably, the member also has means about the groove to meter the chamber coolant into the same.

In most embodiments, the member is supported on the support means adjacent the bottom of the box. Preferably, the support means are connected with the box. Where the member is annular, and the chamber has a bottom opening therein through which the molded work product can emerge from the box, the support means may be disposed adjacent the periphery of the member. For example, in some embodiments, the support means are cantilevered peripherally inwardly from the edge of the box at the bottom opening thereof. And in certain of these embodiments, the support means are formed by an annular plate which is secured to the outer peripheral edge portion of the box at the bottom opening thereof, and cantilevered peripherally inwardly from the edge so as to engage the annular member about the bottom opening thereof.

In fact, the support means may form the aforementioned aperture about the bottom opening of the member through which the chamber coolant can discharge onto the emerging work product during the molding operation. For example, the support means may cooperate with the bottom portion of the member in forming an annular slot through which the coolant can discharge onto the emerging work product. Moreover, the member may have a subchamber formed about the periphery thereof, and there may be means in the periphery of the member to meter coolant into the subchamber from the chamber of the box, the aperture being formed in the bottom portion of the member to discharge the subchamber coolant onto the emerging work product during the molding operation.

Often, the device also further comprises means whereby the leakage can be detected at the outside of the box. The leakage detection means may be operable so that the leakage can be detected adjacent the bottom of the box; or they may be operable so that the leakage can be detected adjacent the top of the box; or they may be operable so that the leakage can be detected adjacent both the top and the bottom of the box.

Preferably, a fluid sealant ring is interposed in the second line of engagement between the member and the defining surfaces of the chamber, as well as in the first line of engagement between the top surface of the member and the top of the chamber.

Often, the device comprises still further, scupper-like means in the top opening of the chamber to enable molten metal to be charged into the cavity of the member from a point above the top of the box. For example, the device may further comprise a hot top on the top of the box having the scupper-like means depending therefrom. In certain embodiments, the scupper-like means are inserted in the top opening of the chamber from the hot top.

A hot top is but one example of means for charging molten metal into the cavity of the member through the respective top openings of the chamber and the member. In many of the presently preferred embodiments of the invention, the molten metal charging means include an assembly of molten metal carrier means, one of which is superposed above the top opening of the member and individually removable from the assembly when desired. In some embodiments, the respective carrier means are supported on top of the box in the manner of a hot top, and the one carrier means has a scupper-like element depending therefrom in the top opening of the chamber. Preferably, the molten metal carrier means are disposed end to end of one another in the assembly and are secured to the top of the box. For example, in certain embodiments, the carrier means take the form of troughed carrier blocks which are clamped to the top of the box. Where the leakage discharge means discharges the leakage onto the top of the box at a location spaced apart from the top opening of the chamber, the molten metal charging means are superposed above the top opening of the chamber to terminate in the space between said location and the top opening of the chamber so that the leakage is visually discernable at said location from points thereabove.

BRIEF DESCRIPTION OF THE DRAWINGS

These features will be better understood by reference to the accompanying drawings which illustrate one of the presently preferred embodiments of the invention, and a modification thereof, in their application to a conventional pit mounted billet casting apparatus.

In the drawings.

DESCRIPTION OF THE PREFERRED EMBODIMENT

Figure 1:
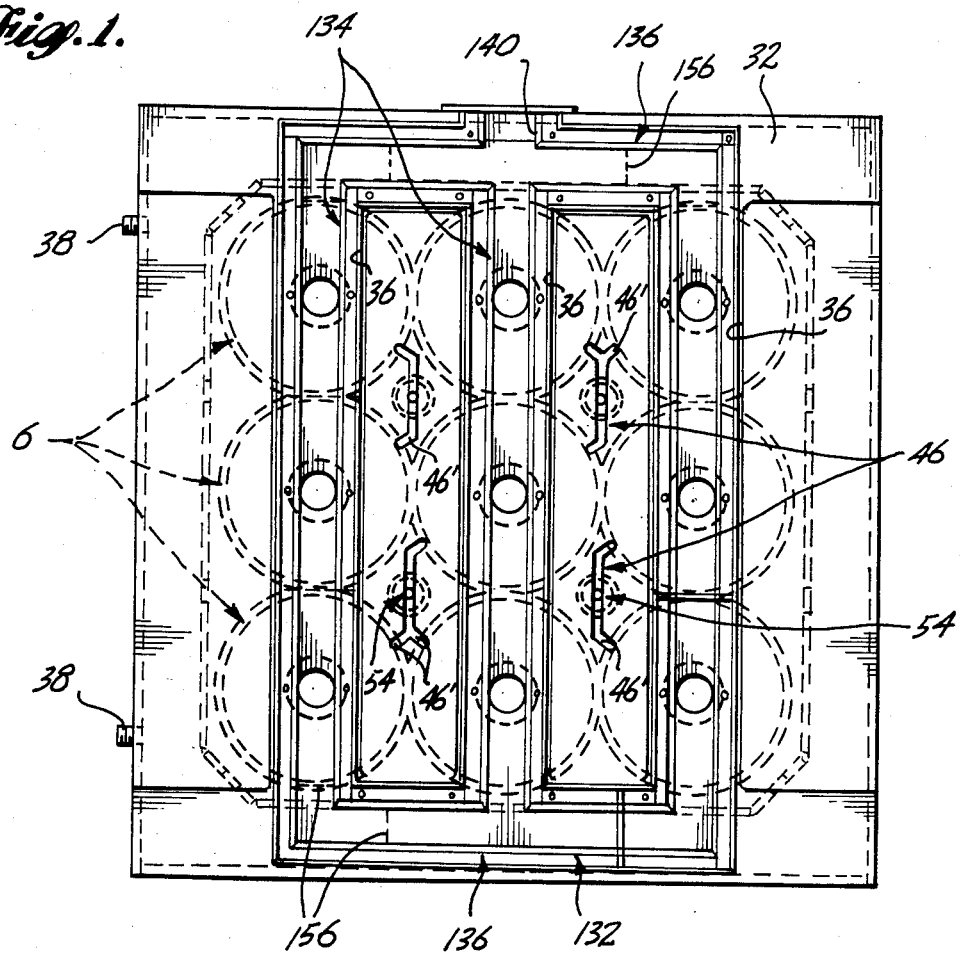
FIG. 1 is a plan view of the billet casting apparatus but with the furnace and any filter for the same omitted from the view.
Figure 2:
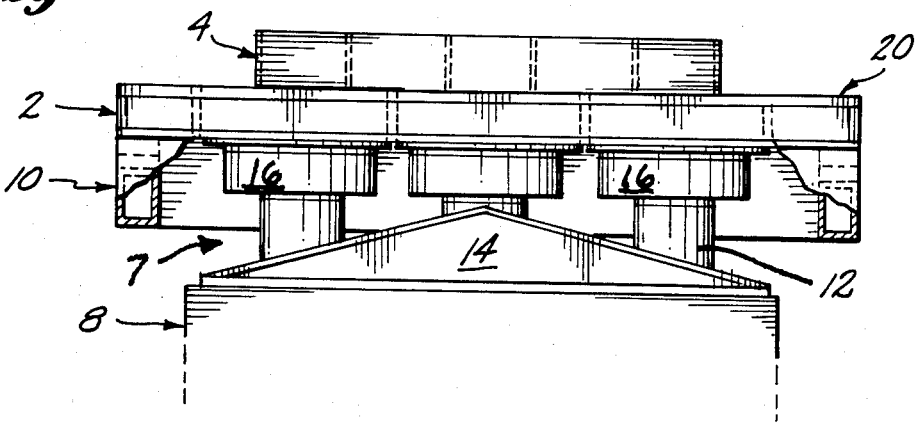
FIG. 2 is a part schematic and elevational view of the apparatus, but with the near side of the supporting frame for the molding device of the same partially removed from the view.

Referring to the drawings, it will be seen that the billet casting apparatus comprises a multiple site molding device 2 of the coolant box type, a hot top 4 for feeding the nine symmetrically arrayed casting sites 6 of the device, and a platen mounted stool assembly 7 for supporting the elongated billets (not shown) progressively formed at the respective sites. The stool assembly and its supporting platen 8 are normally housed in a pit (not shown), and the molding device 2 is supported on a peripheral frame 10 at the top of the pit so that the assembly can be raised and lowered with respect to the device for repeated casting operations therein. Moreover, the pedestal-like stools 12 of the assembly are erected on a teepee-like base 14 for drainage, and the caps 16 of the stools are sized to mate with the sites in conventional fashion when the assembly is engaged in the device. In addition, the device is normally detachably secured to the frame so that it can be tilted up or otherwise removed from the frame to enable the apparatus to be serviced.

Turning now to FIGS. 1–4 in particular, it will be seen that the molding device 2 comprises a large, widely dimensioned box 20 having a correspondingly sized chamber 22 therein for circulating a liquid coolant such as water to the respective casting sites 6, as shall be explained. The box 20 also has equally sized openings 24 in the bottom 26 thereof corresponding in number and location to the casting sites, and the openings 24 are rabbeted about the outer peripheral edges thereof to form annular seats 28 for additional components of the device, as shall also be explained. The top 30 of the box is recessed in part and the recessed surface 32 (FIG. 1) thereof has a channelled grill-like configuration when seen in plan view, as in FIG. 1. Moreover, there are rows of equally sized openings 34 in the three spaced parallel channels 36 of the surface 32, and these top openings 34 are vertically aligned with but smaller than the respective bottom openings 24 of the box at the respective sites 6 therein.

The coolant is fed to the chamber 22 through a pair of nippled inlets 38 (FIG. 1) at one side of the box, and the top of the chamber has an annular rabbet 40 about each top opening 34 therein, the vertical wall 42 of which is rabbeted in turn at the bottom of the same to form an annular shoulder or step 44 thereon. In addition, the box has a series of narrow, stick-figure-like grooves 46 in the top thereof, between the pairs of channels 36, and the grooves 46 are elongated along lines parallel to the aforesaid one side of the box, as seen in FIG. 1. Moreover, the grooves 46 are deep enough at the bottoms 48 thereof to coincide with a level of the chamber spaced below the top surfaces 50 of the rabbets 40 therein, and have obliquely angled extensions 46′ at the opposing ends of the same which open at this same level into one or more of the rabbets 40 at the vertical walls 42 thereof.

The box also has a smaller sized hole 52 (FIG. 4) in the top thereof adjacent each top opening 34 therein. The hole 52 is disposed in the peripheral edge portion of the box at the opening, and opens into the top surface 50 of the rabbet 40 therebelow.

Upstanding in the chamber 22 between the top 30 and bottom 26 of the box is a set of hollow posts 54 that are disposed below the centers of the grooves 46 and open into the same through holes 56 in the top 30 of the box. The posts 54 also open into the ambient surroundings of the box through holes 58 in the bottom 26 of the same, and plumbing 60 (FIG. 4) is passed upwardly through the hollow bore 54′ of each post to a point above the top of the box. The plumbing then elbows over into a parallel with the top of the box and terminates in a nipple 62 that is bayonetted downwardly through and beyond the hole 52 that accompanies the adjacent top opening 34 of the box. Normally, the plumbing 60 in each post 54 is split into several laterals 64 with accompanying nipples 62, to service the holes 52 of two or more stations 6 in the box. However, all of this is omitted from FIGS. 1 and 2 for simplicity.

The molding device 2 also comprises a plurality of billet forming members 66 which are adapted to be mounted in the chamber 22 of the coolant box at the respective casting sites thereof. Each billet forming member 66 is annular in construction and comprises a deep cylindrically inner surfaced metal casting ring 68, a shallower cylindrically inner surfaced oil feed ring 70, and a dome-like conically inner surfaced top ring 72 of insulative refractory material. The casting ring 68 has a deeply inset inner peripheral rabbet 74 at the top thereof, and the oil feed ring 70 and top ring 72 are seated in the rabbet 74 in that order. Moreover, the inner diameter of the oil feed ring 70 is the same as that of the casting ring 68 and that of the top ring 72 at the bottom thereof, so that the member 66 has a smooth cylindrical bore 75 below the bottom of the top ring. Meanwhile, the bore 76 of the top ring 72 is conically stepped down to this dimension from the top opening 78 therein, so that the member can lend itself to its billet forming function when molten metal is poured into the same through the opening 78 and the corresponding cap 12 of the stool 8 is progressively lowered in relation to the bottom of the member. Also, the oil feed ring 70 is constructed of graphite or some other oil impregnable material so that it can provide the necessary lubricating function at an appropriate level in the member.

At the outside thereof, the casting ring 68 has a circumferential groove 80 therein which is relatively radially deeply inset and relatively axially widely spread to leave the casting ring with a relatively thin wall 82 about the girth thereof for rapid heat transfer into the groove 80 from the bore 75 of the member. Exteriorly, the casting ring 68 also has a deeply radially inset outer peripheral rabbet 84 about the bottom thereof, and the vertically oriented wall 84′ of the rabbet 84 is axially inwardly tapered toward the bottom opening 75′ of the bore 75 of the member. Above the rabbet 84, there is a series of apertures 86 which open into the top 84″ of the same from the circumferential groove 80 about the perimeter of the ring, and at somewhat the same incline as the wall 84′ of the rabbet. Meanwhile, at the top of the ring 68, there is a pair of progressively stepped rabbets 88 and 90 about the outer periphery thereof, the inner of which, 88, is shallow axially of the ring but wide, and the outer of which 90, is more deeply inset axially of the ring and characterized with a peripherally outwardly convex wall 90' at its inside, to provide a slightly indented corner 90'' at the inside of the step 90''' of the same. In addition, between the top and bottom thereof, the ring 68 has a rabbet 92 about the circumference of the same at the top of the groove 80, and the bottom portion 68' of the ring is somewhat reduced in diameter at the outer periphery thereof to correspond to the diameter of the rabbet 92 at the inside thereof.

The ring 68 also has a hole 94 in the rabbet 88 at the top thereof, and the hole 94 descends to a point opposite the location of the oil feed ring 70 in the bore 75 of the member. At this point the hole 94 opens through a lateral 94' into the rabbet 74 of the ring, there being a circumferential groove 96 about the rabbet 74 at the opening of the hole 94, and thus about the circumference of the oil feed ring 70 when the ring is assembled in the member. Meanwhile, the top 94'' of the hole is counterbored to a shallow depth, and as shall be seen, is located on the top surface of the member so as to register with the hole 52 in the top of the coolant box when the member is used in making up the corresponding site 6 of the device.

Lastly, the rabbet 74 at the top of the ring is counterbored at the top to a slightly larger radial dimension, and to an axial dimension corresponding to a level slightly below the joint between the oil feed ring 70 and the top ring 72. In addition, the oil feed ring 70 is rabbeted at the outside top corner 98 thereof to a depth corresponding to that of the counterbore 100, and an O-ring 102 is trapped in the rabbet 98 when the oil feed ring and top ring are assembled in the casting ring.

In addition to the three rings 68, 70 and 72, the member 66 also comprises a baffling ring 104 which is sleeved about the outside of the casting ring 68 and seated in the rabbet 92 at the top of the groove 80. The baffling ring 104 is equipped with a series of orifices 106 about the circumference thereof through which coolant in the chamber 22 can meter into the groove 80 for purposes of cooling the member 66 during the casting operation. The coolant discharges in turn through the apertures 86 of the casting ring, and forms into a curtain of the same on the wall 84' above the billet emerging from the bottom of the bore in the member.

The molding device 2 also comprises a plurality of annular attachment plates 108 which are employed to support and retain the members 66 in the box 20. The plates 108 are adapted to be secured to the peripheral edge portions 110 of the box about the bottom openings 24 thereof, and to cantilever into engagement with the corresponding members 66 in the rabbets 84 of the same. However, the inner peripheral edge 112 of the respective plates has a greater diameter than that of the wall 84' of the rabbet, so that the plates cooperate with the walls 84' of the members to form annular slots 114 about the bottoms of the same. The coolant discharging from the apertures 86 thus forms into a curtain in these slots, and the edges 112 of the plates have a chamfer 112' at the inner peripheries thereof which is angled axially inwardly of the same in the downward direction to cooperate with the walls 84' of the members in giving the slots 114 a slope and depth adapted to lend themselves to this purpose. The edges 112 are also undercut below the chamfer 112' to produce a sharp drop off for the coolant at the outer periphery of the slot.

The plates 108 also have annular ridges 116 upstanding about the tops of the same, as well as annular grooves 118 about the ridges, and pairs of holes 120 and 122 in the bodies of the same to accomodate capscrews 124 employed in securing the plates to the box and the member. The relatively outside holes 120 register with corresponding holes 126 in the peripheral edge portions 110 of the box about the bottom openings 24 thereof, and the relatively inside holes 122 register with corresponding holes 128 in the bottom portions 68' of the casting rings in the members. Meanwhile, the ridges 116 are adapted to be insertedly engaged between the edges of the openings 24 and the bottom portions 68' of the members to locate the members in the openings and to support the baffling rings 104 therearound when the members are mounted in the box, as shall be explained.

The hot top 4 comprises a parapet-like assembly 130 which has a grill-like appearance in plan view and is superposed on the top of the box to overlie the top openings 34 in the surface 32 thereof. The assembly 130 includes a molten metal distribution pan 132 which is troughed in cross-section at the three spaced parallel runners 134 (FIG. 1) and interconnecting headers 136 thereof. The trough 138 (FIG. 3) is fed through an inlet 140 (FIG. 1) at the top thereof in FIG. 1, and is surrounded inside and outside of the pan by rampart-like plate metal walls 142 having spaced cleats 144 along the insides thereof near the tops of the walls. The walls 142 are set off from the sides of the trough 138, and the trough has a refractory paper gasket 146 at the underside thereof, and an insulative blanket 150 of fibrous refractory material to each side thereof in the spaces between the trough and the walls 142. In addition, the trough 138 is clamped in place by pairs of hold down plates 152 which are capscrewed to the tops of the cleats 144 to overlie the top of the trough at each side thereof.

The pan 132 is not monolithic, but instead is formed from a plurality of discrete insulative ceramic blocks 154 which are abutted end to end of one another in the grill-shaped configuration of FIG. 1, with the butt joints 156 (FIG. 1) between blocks 154 being staggered to place individual blocks over the respective top openings 34 in the channels 36 of the surface 32, and the joints 156 of the remaining blocks being arranged so that the assembly 130 will lend itself to the removal of a single block without the necessity for removing any other blocks, including the adjoining blocks. Consistent with this, moreover, the hold down plates 152 are likewise subdivided into pairs of shorter plates 158 that correspond in length to the blocks 154 and are placed in registry with individual blocks so that access can be gained to any one block by removing only the pair of plates 158 corresponding thereto. Thus when servicing the apparatus it is not necessary to remove the entire hot top assembly, for example, when replacing some portion or segment thereof, such as that block 154 above one of the casting sites 6. Also, as shall be explained, it is not necessary to remove any portion of the hot top assembly to gain access to the various sites 6 and the billet forming members 66 therein.

The molten metal in the pan 132 reaches the casting sites 6 through scupper-like elements 160 (FIG. 3) depending from the bottoms of those blocks 154 disposed above the top openings 34 in the box. The elements 160 have tapered bores 162 and stepped cylindrical outer configurations. The tops of the elements are adapted to be telescopically engaged in the adjacent top openings 34 of the box, and the reduced tips 160' of the elements are adapted to similarly engage in the top openings 78 of the corresponding billet forming members.

The elements 160 may be formed separately from the blocks themselves if desired, to enable the elements to be formed from a differing material and/or bottom mounted in the openings 34 through the chamber, as for example where they are flanged and the flanges of the same are fastened to the top of the chamber, for instance by clips.

The members 66 are mounted in the box by inserting them upwardly through the bottom openings 24 thereof; and as seen in the drawings, the outer peripheries of the members at the rabbets 90 and the baffling rings 104 thereof, are sized to be slidably inserted through the bottom openings, and the top openings 78 of the members are sized to be telescopically engaged about the mandrel-like tips 160' of the scupper elements of the pan as the members approach the top of the chamber. Also, the convexly-shaped inside walls 90' of the rabbets 90 of the members are sized to be slidably engaged with the walls 42 of the rabbets 40 in the chamber, and the steps 90''' of the rabbets 90 are sized to oppose the steps 44 in the chamber, but with a slight clearance therebetween, when the tops of the members actually abut the peripheral surfaces 50 of the chamber. Furthermore, as indicated earlier and assuming the appropriate angular orientation for the members, the counterbored holes 94 in the rabbets 88 of the members at the tops thereof, are disposed to register with the tips 62' of the plumbing nipples 62 projecting into the chamber at the top thereof, so that these tips 62' can be bayonetted into the counterbores 94'' of the holes 94 when the members abut the top of the chamber. Thereafter, the annular plates 108 are applied to the bottom 26 of the box to retain the members 66 in the same, and as indicated earlier, the ridges 116 of the plates are interengaged between the edges of the openings 24 and the outer peripheries of the rings 68 to locate the members in the openings and to support the baffling rings 104 against the tops of the rabbets 92 in the rings. The plates 108 are then secured to the box and the respective members, using the capscrews 124. However, O-rings 164 are normally clamped between the plates and the box in the grooves 118 to seal the joints therebetween at the bottoms of the baffling rings.

Figure 3:
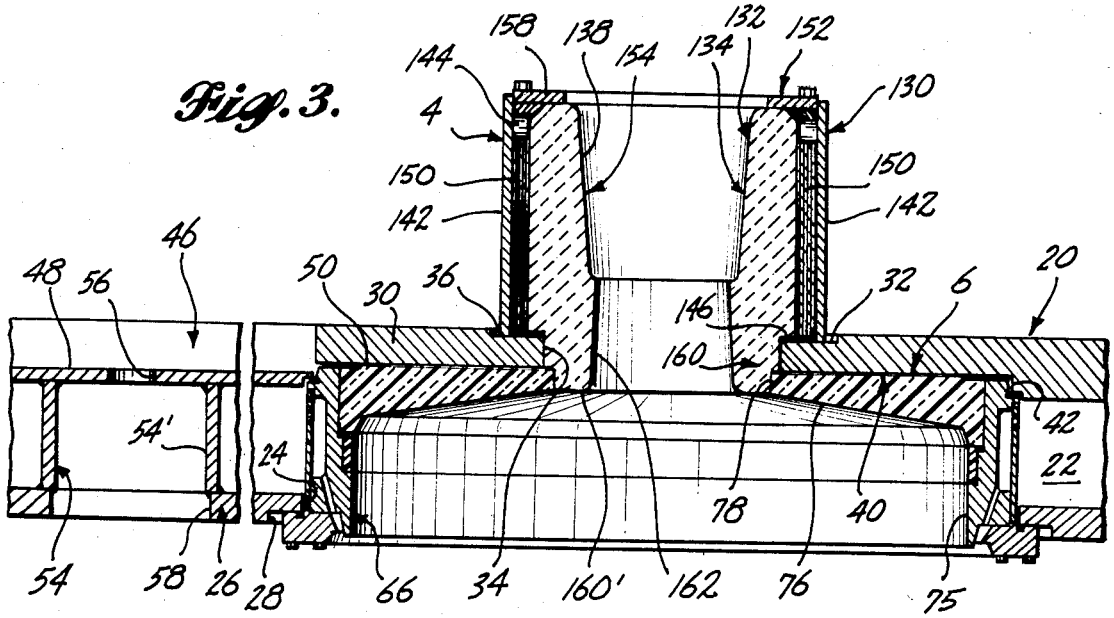
FIG. 3 is a vertical part cross-sectional view of the molding device and a hot top thereon at one of the casting sites in the device.
Figure 4:
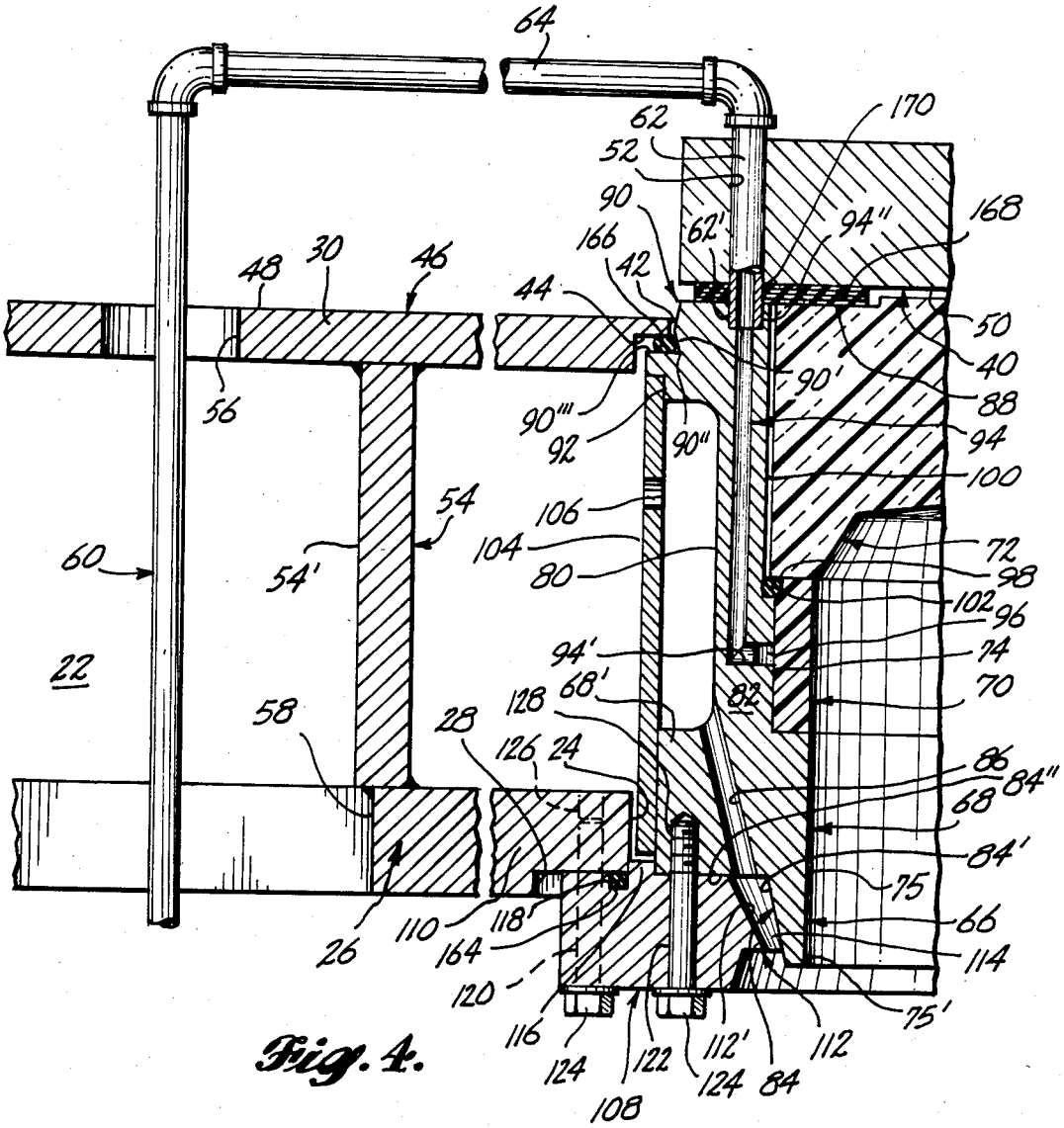
FIG. 4 is an enlarged part cross-sectional view of the foregoing site in the same vertical plane.

Referring now to FIGS. 3 and 4 in particular, it will be seen that the inserted portion of each member 66 is connected with the wall of the chamber at the opposing steps 90, 44 thereof, and at the interfacial annulus 50 formed between the respective peripheral surfaces thereof about the edges of the top openings 78, 34 therein. Moreover, elastomeric fluid sealant rings 166 and 168 are interposed in the connections to seal the joints thereacross. The ring in the connection 90, 44 takes the form of an O-ring, and the O-ring 166 is trapped in the corner 90'' of the step 90 of the member below the convexity of the wall 90' when the member is inserted in the chamber, so as to be clamped between the steps 90, 44 when the member is abutted against the top of the chamber and clamped in place by the accompanying plate 108. The ring in the annulus 50 takes the form of a flat gasket-like ring, and the latter ring 168 is seated in the rabbet 88 of the member to be clamped between it and the top of the chamber when the member is abutted against the top of the chamber and secured in place by the plate 108. The ring 168 has a hole 170 therein to pass the tip 62' of the nipple 62 of the plumbing 60, and the tip 62' is bayonetted through the hole to reach the counterbore 94'' of the hole 94 in the member, as indicated earlier. The plumbing is thus interconnected with the groove 96 at the periphery of the oil feed ring 70 to enable oil to be fed to the ring 70 for impregnation of the same during the molding operation.

According to the invention, the connection between the steps 90, 44 is protected against any leakage thereacross reaching the bore 75 of the member through the top opening 78 thereof, and in fact even reaching the connection 50 at the annulus, by the fact that the vertical gap between the two connections opens into the groove 46 and the groove is at a pressure adapted so that any leakage coolant will discharge into the same, rather than enter the connection 50, or worse yet the bore 75 of the member. Moreover, because each groove 46 is drained by a post 54, the leakage coolant will ultimately discharge to the ambient surroundings of the box at the bottom thereof, and will be seen at the opening 58 to the post.

When it is desired to service one or more of the sites 6, the corresponding plate 108 is detached from the box 20 and/or the member 66, and the member is lowered through the bottom opening 24 of the box to remove it from the same, the connections 90, 44 and 50 meanwhile readily disengaging from one another because of the unfastened nature of the same.

Figure 5:
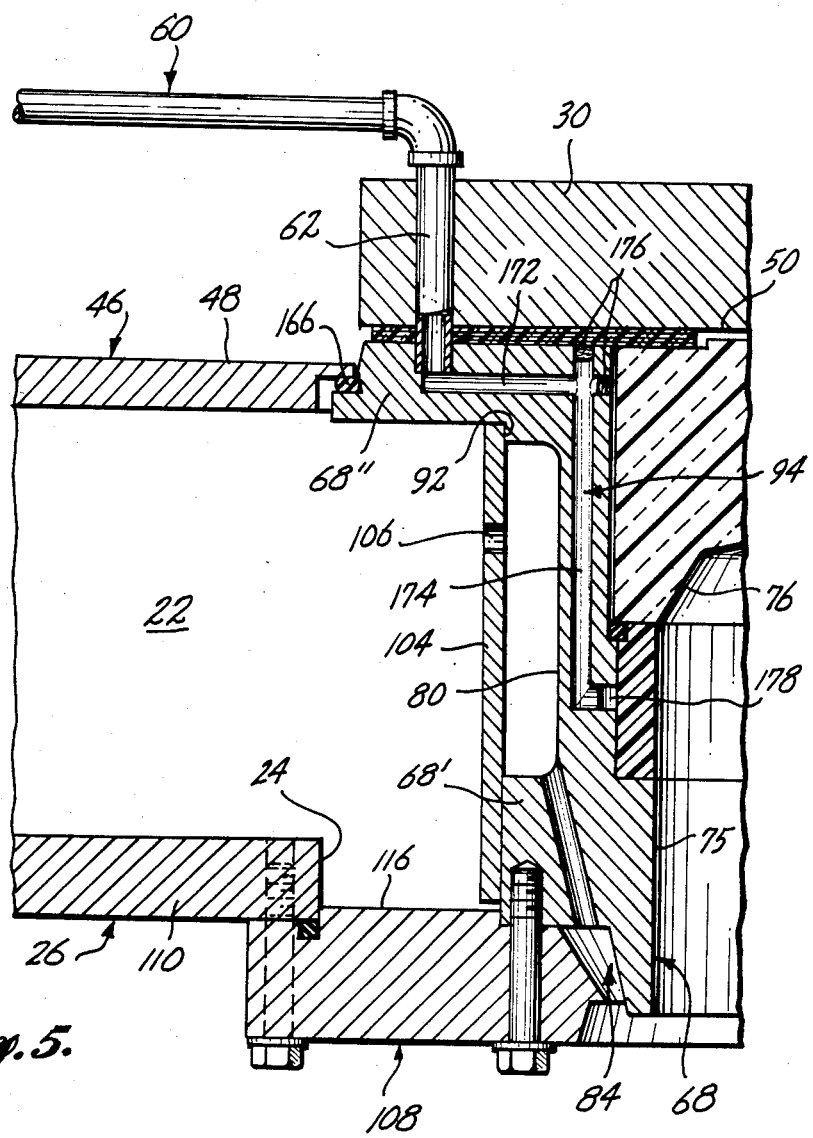
FIG. 5 is another such view but reduced in cross-section and showing a modification of the embodiment illustrated in FIGS. 1–4.

In FIGS. 1–4, the bore 75 of the billet forming members 66 is sized to produce the maximum billet diameter, such as 16 inches. In FIG. 5, the bore 75 of the billet forming members has been reduced in size to produce a smaller diameter billet, yet the members remain adapted to be mounted in the same bottom openings 24 as were employed in FIGS. 1–4. This is accomplished by reducing the diameters of the groove 80, the shoulder 92 and the bottom portion 68' of the casting ring 68 in each member, to retain the same wall thickness for the casting ring notwithstanding the smaller diameter of the bore therein, while retaining the diameter of the top portion 68'' of the ring and increasing the width of the annular plate 108 and the ridge 116, between the inner and outer diameters thereof, to enable the plate to cantilever into engagement with the rabbet 84 of the member, as in FIGS. 1–4. In addition, the oil feed passage 94 in the casting ring is formed in two, right angularly related legs 172 and 174 to pass around the groove 80, and the open ends of the legs at the junction between the same are filled with spot wells 176 to close the passage other than at the circumferentially grooved end 178 thereof. Otherwise, the member 66 is constructed in substantially similar fashion to that of FIGS. 1–4, and is mounted and connected with the box in similar fashion as well.

What is claimed is:

1. In a metal molding device, a coolant box, inside surfaces of which define the relatively top, bottom and side walls of an enclosed chamber adapted for the flow of liquid coolant through the box, the top of said chamber having an opening therein on a vertical axis of the box, a top opening mold cavity defining member, means on the bottom of the box whereby the mold cavity defining member is insertable in the chamber on the axis, support means adjacent the bottom of the chamber whereby the member is supportable in the box in a telescoping assembly in which the top opening of the member is co-axial with the top opening of the chamber to enable molten metal to be introduced to the cavity of the member through the respective top openings of the chamber and the member, said mold cavity defining member having a greater outer peripheral diameter transverse the axis than the top opening of said member, first means on the mold cavity defining member and the box forming a first line of engagement between the member and the defining surfaces of the chamber in which a top surface of the member about the opening thereof engages the top of the chamber about the opening thereof in a first horizontal plane of the box, second means on the mold cavity defining member and the box forming a second line of engagement between the member and the defining surfaces of the chamber about the aforesaid top surface of the member, said second line of engagement being formed in a second horizontal plane of the box which is spaced below the aforesaid first horizontal plane of the box by a vertical gap, and being adapted to forestall liquid coolant from entering the cavity of the member along the top surface thereof, and means associated with the box for discharging liquid coolant from the chamber, said coolant discharge means being disposed so that any liquid coolant which leaks into the gap through the second line of engagement is discharged from the gap at a level below the aforesaid first horizontal plane of the box and to a point outside of the chamber at which the leakage cannot reach the cavity of the member along the aforesaid top surface thereof.

2. The molding device according to claim 1 wherein the gap opens to the outside of the chamber at a level below the aforesaid first horizontal plane of the box and the leakage discharge means are cionnected with the gap at the opening thereof to discharge the leakage to a point outside of the chamber.

3. The device according to claim 1 wherein the top surface of the mold cavity defining member engages the top of the chamber along a line disposed in the plane of the top opening of the member.

4. The device according to claim 1 wherein the top surface of the member engages the top of the chamber along a line disposed in the plane of the top opening of the member, as well as along a line disposed in a plane spaced below the aforementioned plane of the top opening of the member, and the vertical gap between the two lines of engagement opens into a sump disposed peripherally outwardly of the member and opening into the ambient surroundings of the box so that any coolant which rises above the relatively lower plane is discharged from the chamber before the coolant can reach the plane of the opening in the member.

5. The device according to claim 4 wherein the upper end surface of the member about the edge of the top opening therein abuts the top of the chamber, and there is a step in the top of the member spaced peripherally outwardly from the top opening thereof, which abuts a mutually opposing step in the top of the chamber in the plane spaced below the plane of the opening in the member.

6. The device according to claim 5 wherein one of the steps opens into a recess in the top of the box, which opens in turn into a drain line that discharges through an outlet in the bottom of the box.

7. The device according to claim 6 wherein the drain line passes through a portion of the chamber.

8. The device according to claim 7 wherein there is a groove in the top of the box which opens into the step in the top of the chamber, and discharges to the bottom of the box through a hollow post interposed between the top and bottom of the box in the chamber.

9. The device according to claim 1 further comprising hollow post-like means upstanding in the chamber between the top and bottom of the box, said post-like means opening into the ambient surroundings of the box at the bottom thereof and communicating with the gap in the chamber.

10. The device according to claim 1 wherein the box has a recess in the top thereof which communicates with the vertical gap in the chamber.

11. The device according to claim 1 wherein the box has a step in the top surface of the chamber and the gap in the chamber communicates with the ambient surroundings of the box at the step.

12. The molding device according to claim 1 wherein the member terminates at the inner peripheral edge of the top opening of the chamber and engages the walls of the chamber to prevent coolant from leaking into the cavity of the member through the top opening thereof.

13. The molding device according to claim 1 wherein the second line of engagement has a greater diameter in the chamber than the top opening thereof.

14. The device according to claim 1 wherein the gap has a pressure which is adapted to prevent chamber coolant from leaking into the top opening of the member.

15. The device according to claim 14 wherein the gap has a pressure which is adapted so that any coolant that leaks through the second line of engagement is discharged to a point outside of the chamber before the coolant can reach the top opening of the member.

16. The device according to claim 15 wherein the gap opens into a sump below the top opening of the member and the pressure in the sump is adapted so that the leakage coolant will discharge into it by gravity flow.

17. The device according to claim 16 wherein the sump opens to the ambient surroundings of the box so that the pressure in the gap corresponds thereto.

18. The device according to claim 16 wherein the sump is disposed about the periphery of the gap.

19. The device according to claim 18 wherein the sump opens to the ambient surroundings of the box at a point between the gap and the periphery of the box.

20. The device according to claim 19 wherein the sump opens into the bottom of the box.

21. The device according to claim 1 wherein has a bottom opening therein through which the molded work product can emerge from the box at the bottom thereof.

22. The device according to claim 21 wherein there is an aperture about the bottom opening of the member whereby the chamber coolant can discharge onto the emerging work product during the molding operation.

23. The device according to claim 22 wherein the top and bottom openings of the member are coaxial with the top and bottom openings of the chamber, and the discharge aperture is formed between the body of the member and the bottom opening of the chamber.

24. The device according to claim 22 wherein the member has substantially the same diameter as the bottom opening of the chamber, and there are means in the bottom portion of the member which communicate with the chamber of the box at a point above the bottom opening therein to form the discharge aperture.

25. The device according to claim 24 wherein the member has a circumferential groove about the waist portion thereof, and an annular rabbet at the bottom thereof which is interconnected with the groove by a series of apertures through which the chamber coolant can discharge onto the emerging work product from the groove.

26. The device according to claim 25 wherein the member has means about the groove to meter the chamber coolant into the same.

27. The device according to claim 1 wherein the mold cavity defining member is annular, the chamber has a bottom opening therein on the aforesaid vertical axis of the box through which the mold cavity defining member is insertable in the chamber, and there are means on the member within the diameter of the bottom opening of the chamber through which liquid coolant in the chamber is metered onto the work product emerging from the member at the bottom thereof.

28. The device according to claim 1 wherein the member is supported on the support means adjacent the bottom of the box.

29. The device according to claim 28 wherein the support means are connected with the box.

30. The device according to claim 28 wherein the member is annular, the chamber has a bottom opening therein through which the molded work product can emerge from the box, and the support means are disposed adjacent the periphery of the member.

31. The device according to claim 30 wherein the support means are cantilevered peripherally inwardly from the edge of the box at the bottom opening thereof.

32. The device according to claim 31 wherein the support means are formed by an annular plate which is secured to the outer peripheral edge portion of the box at the bottom opening thereof, and cantilevered peripherally inwardly from the edge so as to engage the annular member about the bottom opening thereof.

33. The device according to claim 28 wherein there is an aperture about the bottom opening of the member through which the chamber coolant can discharge onto the emerging work product during the molding operation, and the support means form the aperture.

34. The device according to claim 33 wherein the support means cooperate with the bottom portion of the member in forming an annular slot through which the coolant can discharge onto the emerging work product.

35. The device according to claim 33, wherein the member has a subchamber formed about the periphery thereof, there are means in the periphery of the member to meter coolant into the subchamber from the chamber of the box, and the aperture is formed in the bottom portion of the member to discharge the subchamber coolant onto the emerging work product during the molding operation.

36. The molding device according to claim 1 further comprising means whereby the leakage can be detected at the outside of the box.

37. The device according to claim 36 wherein the leakage detection means are operable so that the leakage can be detected adjacent the bottom of the box.

38. The device according to claim 36 wherein the leakage detection means are operable so that the leakage can be detected adjacent the top of the box.

39. The device according to claim 1 wherein a fluid sealant ring is interposed in the second line of engagement between the member and the defining surfaces of the chamber, and in the first line of engagement between the top surface of the member and the top of the chamber.

40. The device according to claim 1 further comprising scupper-like means in the top opening of the chamber to enable molten metal to be charged into the cavity of the member from a point above the top of the box.

41. The device according to claim 40 further comprising a hot top on the top of the box having the scupper-like means depending therefrom.

42. The device according to claim 41 wherein the scupper-like means are inserted in the top opening of the chamber from the hot top.

43. The device according to claim 1 further comprising means for charging molten metal into the cavity of the member through the respective top openings of the chamber and the member.

44. The device according to claim 43 wherein the molten metal charging means include an assembly of molten metal carrier means, one of which is superposed above the top opening of the chamber and individually removable from the assembly when desired.

45. The device according to claim 44 wherein the respective carrier means are supported on top of the box in the manner of a hot top, and the one carrier means has a scupper-like element depending therefrom in the top opening of the chamber.

46. The device according to claim 45 wherein the molten metal carrier means are disposed end to end of one another in the assembly and are secured to the top of the box.

47. The device according to claim 46 wherein the carrier means take the form of troughed carrier blocks which are clamped to the top of the box.

48. The device according to claim 43 wherein the leakage discharge means discharges the leakage onto the top of the box at a location spaced apart from the top opening of the chamber, and the molten metal charging means are superposed above the top opening of the chamber to terminate in the space between said location and the top opening of the chamber so that the leakage is visually discernable at said location from points thereabove.

49. The device according to claim 1 wherein there is an opening in the bottom of the chamber on the axis through which the mold cavity defining member is insertable in the chamber.

50. In a metal molding device, a coolant box, inside surfaces of which define the relatively top, bottom and side walls of an enclosed chamber adapted for the flow of liquid coolant through the box, the top and bottom of said chamber having openings therein on a vertical axis of the box, the bottom of which openings is greater in diameter than the top opening of said chamber, support means adjacent the bottom of the chamber for supporting a top opening mold cavity defining member insertable in the chamber on the axis through the bottom opening thereof in a telescoping assembly in which the top opening of the member is co-axial with the top opening of the chamber to enable molten metal to be introduced to the cavity of the member through the respective top openings of the chamber and the member, said mold cavity defining member having a greater outer peripheral diameter transverse the axis than the top opening of said chamber, first means at the top of the chamber for engaging a top surface of the member about the opening thereof to form a first line of engagement between the member and the defining surfaces of the chamber in a first horizontal plane of the box, second means at the top of the chamber defining a step which is spaced peripherally outwardly from the top opening of the chamber for forming a second line of engagement between the member and the defining surfaces of the chamber, said second line of engagement being formed in a second horizontal plane of the box which is spaced below the aforesaid first horizontal plane of the box by a vertical gap, to forestall liquid coolant from entering the cavity of the member along the top surface thereof, means defining a sump disposed outside the chamber below the aforesaid first horizontal plane of the box and opening into the chamber at a point in the gap adjacent the step so that liquid coolant which leaks into the gap through the second line of engagement is discharged into the sump at a level below the aforesaid first horizontal plane of the box, and means for discharging the leakage coolant from the sump to a point outside of the chamber at which the leakage cannot reach the cavity of the member along the aforesaid top surface thereof.

51. The device according to claim 50 wherein the sump opens to the ambient surroundings of the box so that the pressure in the gap corresponds thereto.

52. The device according to claim 51 wherein the sump opens to the ambient surroundings of the box at a point between the top opening of the chamber and the periphery of the box.

53. The device according to claim 50 wherein the sump opens into the bottom of the box.

54. The device according to claim 50 wherein the step opens into a recess in the top of the box.

55. The device according to claim 50 wherein the recess opens in turn into a drain line that discharges through an outlet in the bottom of the box.

56. The device according to claim 55 wherein the drain line passes through a portion of the chamber.

57. The device according to claim 50 wherein there is a groove in the top of the box which opens into the step in the top of the chamber, and discharges to the bottom of the box through a hollow post interposed between the top and bottom of the box in the chamber.

58. The device according to claim 50 further comprising means for charging molten metal into the cavity of the member through the respective top openings of the chamber and the member.

59. The device according to claim 58 wherein the leakage discharge means discharges the leakage onto the top of the box at a location spaced apart from the top opening of the chamber, and the molten metal charging means are superposed above the top opening of the chamber to terminate in the space between said location and the top opening of the chamber so that leakage is visually discernable at said location from points thereabove.

60. The device according to claim 58 wherein the chamber has a plurality of top openings therein for a corresponding number of top-opening mold cavity defining members insertable in the chamber through corresponding bottom openings thereof, and the molten metal charging means include an assembly of molten metal carrier means, certain of which are superposed above the respective top openings of the chamber and are individually removable from the assembly when desired.

61. The device according to claim 60 wherein the respective carrier means are supported on top of the box in the manner of a hot top, and those superposed above the top openings of the chamber have scupper-like elements depending therefrom in the top openings.

62. The device according to claim 61 wherein the molten metal carrier means are disposed end to end of one another in the assembly thereof, and are secured to the top of the box.

63. The device according to claim 62 wherein the carrier means take the form of troughed carrier blocks which are clamped to the top of the box.

64. The device according to claim 50 wherein the aforesaid second line of engagement is disposed opposite the bottom opening of the chamber.

65. The device according to claim 50 further comprising means whereby any leakage through the second line of engagement can be detected at the outside of the box.

66. The molding device according to claim 50 wherein there are hollow post-like means upstanding in the chamber between the top and bottom of the box, the hollow of said post-like means opening into the sump and communicating with the ambient surroundings of the box at the bottom thereof.

67. The device according to claim 66 wherein the sump takes the form of a recess in the top of the box which interconnects the gap in the chamber with the hollow of the post-like means.

68. The device according to claim 67 wherein the recess takes the form of a groove in the top of the box.

69. The device according to claim 50 wherein the step is formed by an annular rabbet in the top of the chamber.

* * * * *

UNITED STATES PATENT AND TRADEMARK OFFICE

CERTIFICATE OF CORRECTION

PATENT NO. : 4,597,432

DATED : July 1, 1986

INVENTOR(S) : Richard J. Collins, Frank E. Wagstaff, William G. Wagstaff

It is certified that error appears in the above-identified patent and that said Letters Patent are hereby corrected as shown below:

Column 10, line 47 thereof, "wells" should be "welds".

Claim 2, line 4 thereof, "cionnected" should be "connected".

Claim 21, line 1 thereof, after "wherein" should be inserted "the mold cavity defining member is annular and the chamber".

Claim 1, at line 6 of column 11, "member" should be "chamber".

Signed and Sealed this

Twenty-first Day of October, 1986

[SEAL]

*Attest:*

DONALD J. QUIGG

*Attesting Officer*

*Commissioner of Patents and Trademarks*